US007755446B2

(12) United States Patent
Lin

(10) Patent No.: US 7,755,446 B2
(45) Date of Patent: Jul. 13, 2010

(54) WAVEGUIDE AND METHOD FOR ADJUSTING WAVEGUIDE STRUCTURE THEREOF

(75) Inventor: Chih Jung Lin, Hsinchu (TW)

(73) Assignee: Microelectronics Technology Inc., Hsinchu (TW)

( * ) Notice: Subject to any disclaimer, the term of this patent is extended or adjusted under 35 U.S.C. 154(b) by 98 days.

(21) Appl. No.: 12/122,281

(22) Filed: May 16, 2008

(65) Prior Publication Data

US 2009/0174506 A1 Jul. 9, 2009

(30) Foreign Application Priority Data

Jan. 9, 2008 (TW) ..... 97100775 A

(51) Int. Cl.
*H01P 1/16* (2006.01)

(52) U.S. Cl. ..... 333/21 A; 333/34

(58) Field of Classification Search ..... 333/21 A, 333/34

See application file for complete search history.

(56) References Cited

U.S. PATENT DOCUMENTS 2,535,251 A * 12/1950 Alford ..... 333/257
4,686,491 A * 8/1987 Howard ..... 333/21 A
5,995,057 A * 11/1999 Faith et al. ..... 343/781 R
6,518,853 B1 * 2/2003 O'Connell ..... 333/21 R

* cited by examiner

*Primary Examiner*—Benny Lee
(74) *Attorney, Agent, or Firm*—WPAT, P.C.; Anthony King

(57) ABSTRACT

A waveguide comprises a connecting part, a main chamber and a buffer. The connecting part is connected to the main chamber via the buffer. The side length of the junction between the connecting part and the buffer is smaller than that of the junction between the buffer and the main chamber.

17 Claims, 6 Drawing Sheets

WAVEGUIDE AND METHOD FOR ADJUSTING WAVEGUIDE STRUCTURE THEREOF

BACKGROUND OF THE INVENTION (A) Field of the Invention

The present invention relates to a waveguide, and more particularly, to a method for adjusting the structure of a waveguide to improve the quality of transmitting and receiving signals thereof.

(B) Description of the Related Art

Waveguides are usually utilized in satellite communication to connect antenna and signal processing units, which execute signal processing of transmitting and receiving satellite signals. A circular polarized waveguide is composed of a splitter and a polarizer. The splitter divides transmitting satellite signals with the same phase into vertical and horizontal parts. The polarizer further shifts the vertical and horizontal satellite signals into satellite signals with phase difference of 90 degrees.

Conventional circular polarized waveguides with corrugated structure applied in Ka band often have spikes in the frequency response of their transmitting signals and therefore the quality of their transmitting signals is affected. In addition, the quality of the receiving signals is also affected due to the reflecting signals of the receiving signal. Therefore, there is a need to design a method to adjust the structure of waveguides to improve the quality of transmitting and receiving signals.

SUMMARY OF THE INVENTION

The first embodiment of the present invention is a waveguide comprising a connecting part, a main chamber and a buffer. The buffer connects the connecting part and the main chamber. The side length of the junction between the connecting part and the buffer is smaller than that of the junction between the buffer and the main chamber.

The second embodiment of the present invention is a method for adjusting the structure of a waveguide to improve the quality of its transmitting and receiving signals comprising the step of reducing a first side length of the junction between the connecting part and the buffer so that the first side length is shorter than a second side length of the junction between the main chamber and the buffer.

BRIEF DESCRIPTION OF THE DRAWINGS

The objectives and advantages of the present invention will become apparent upon reading the following description and upon reference to the accompanying drawings in which.

DETAILED DESCRIPTION OF THE INVENTION

Figure 1A:
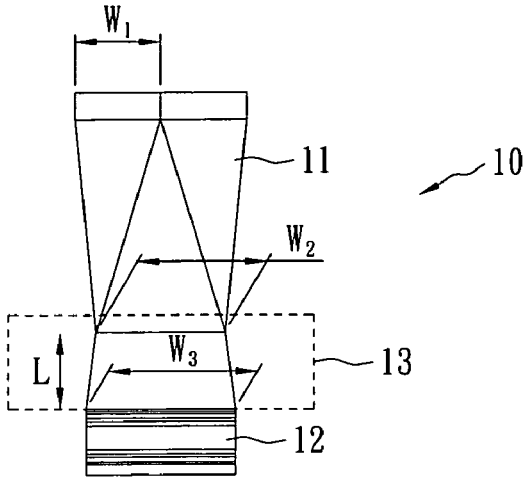
FIG. 1A shows a part of the top view of a waveguide of the first embodiment of the present invention.
Figure 1B:
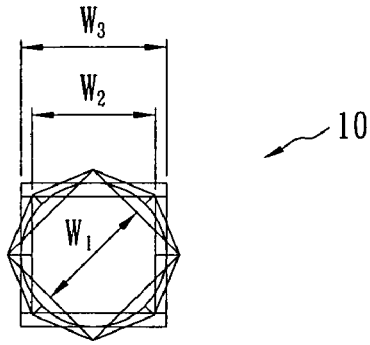
FIG. 1B shows a front view of a waveguide of the first embodiment of the present invention.
Figure 1C:
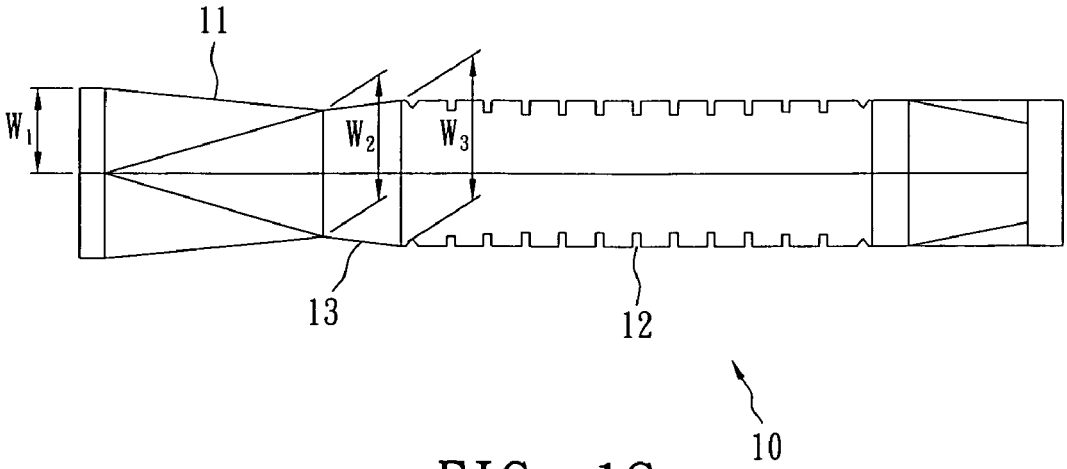
FIG. 1C shows a side view of a waveguide of the first embodiment of the present invention.

FIG. 1A shows a part of the top view of a waveguide 10 of the first embodiment of the present invention. FIG. 1B shows a front view of the waveguide 10. FIG. 1C shows a side view of the waveguide 10. The waveguide 10 comprises a connecting part 11, a main chamber 12 and a buffer 13 as shown in FIGS. 1A & 1C. The connecting part 11 is a power splitter connecting to a signal processing unit to divide transmitting satellite signals having the same phase into vertical and horizontal parts. The main chamber 12 is a dual-band polarizer with a corrugated structure to shift the vertical and horizontal satellite signals into satellite signals with phase difference of 90 degrees being transmitted to an antenna. The buffer 13 connects the connecting part 11 and the main chamber 12. As can be shown in FIGS. 1A, 1B & 1C, the side length of the opening end of the connecting part 11 is $W_1$. The side length of the junction between the connecting part 11 and the buffer 13 is $W_2$. The side length of the junction between the buffer 13 and the main chamber 12 is $W_3$. The length of the buffer 13 is L as shown in FIG. 1A.

The waveguide 10 exhibits a high frequency transmitting band and a low frequency receiving band. To solve the problem of the spikes induced in the transmitting band of the waveguide 10, $W_2$ is shortened in the first embodiment of the present invention to keep the spikes away from the transmitting frequency response.

Figure 2A:
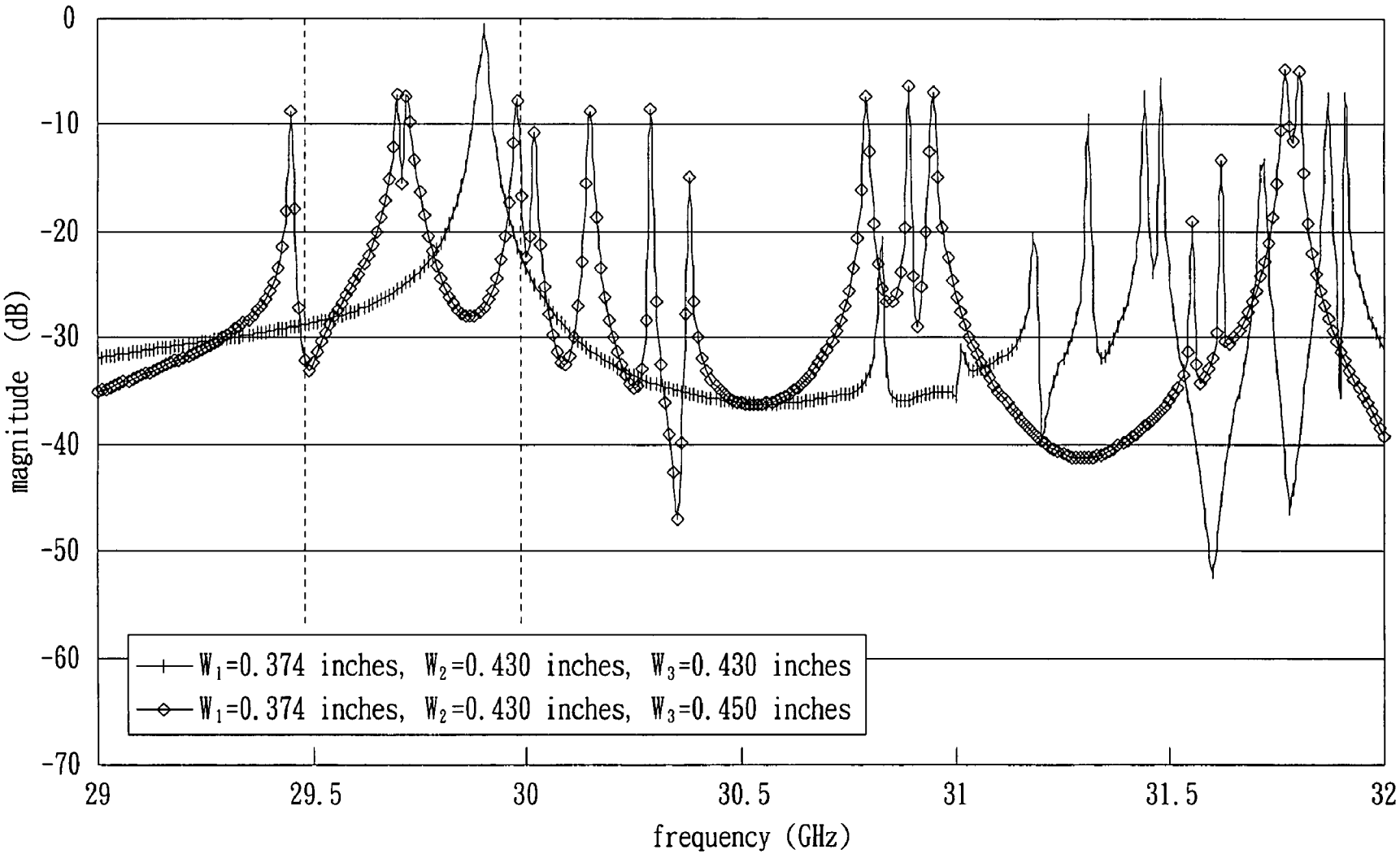
FIG. 2A shows a transmitting frequency response of the first embodiment of the present invention.

FIG. 2A shows a transmitting frequency response (GHz) vs. magnitude (dB) response of the first embodiment of the present invention. As shown in FIG. 2A, when $W_1$ is fixed at 0.374 inches and $W_2$ is fixed at 0.43 inches, as $W_3$ becomes shorter, (from 0.45 inches to 0.43 inches), fewer spikes are induced in the transmitting band of the waveguide 10. As shown in FIG. 2A, the waveguide with the parameter W3 as 0.43 inches has fewer spikes and lower magnitude in the transmitting band of 29.5 GHz to 30 GHz than the waveguide with the parameter W3 as 0.45 inches. Preferably, $W_3$ is between 0.425 and 0.435 inches.

Figure 2B:
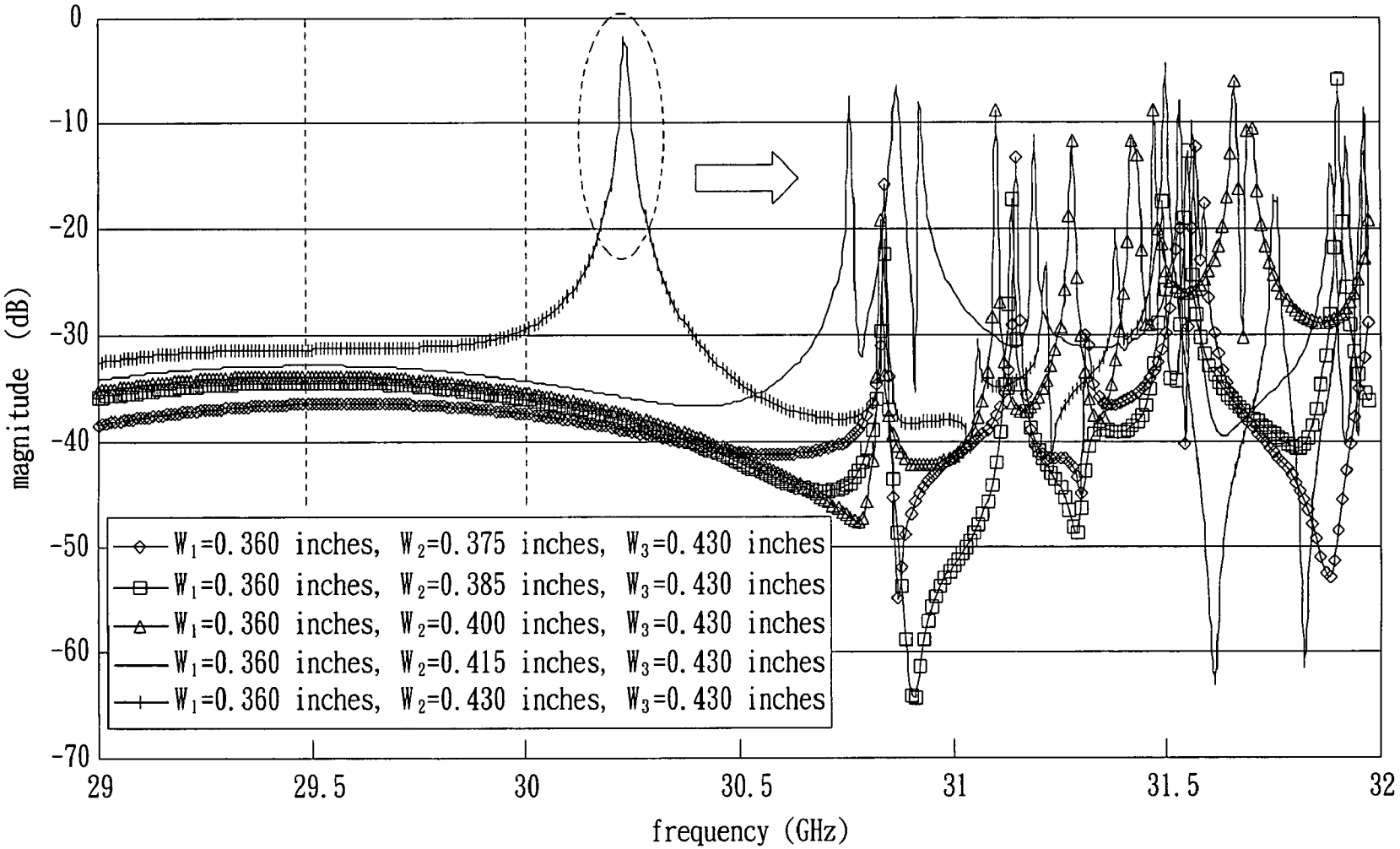
FIG. 2B shows another transmitting frequency response of the first embodiment of the present invention.

FIG. 2B shows another transmitting frequency response of the first (GHz) vs. magnitude (dB) response of the first embodiment of the present invention. As shown in FIG. 2B, when $W_1$ is fixed at 0.36 inches and $W_3$ is fixed at 0.43 inches, as $W_2$ becomes shorter (from 0.43 inches to 0.375 inches), the spikes induced become farther away from the transmitting band of the waveguide 10. As shown in FIG. 2B, when $W_2$ is 0.43 inches, a spike is induced as marked by the encircled portion. As $W_2$ becomes shorter (from 0.43 inches to 0.375 inches), the spikes induced become farther away from the transmitting band of 29.5 GHz to 30 GHz as marked by the arrow. Preferably, the ratio of $W_2$ to $W_1$ is smaller than 1.2.

Figure 2C:
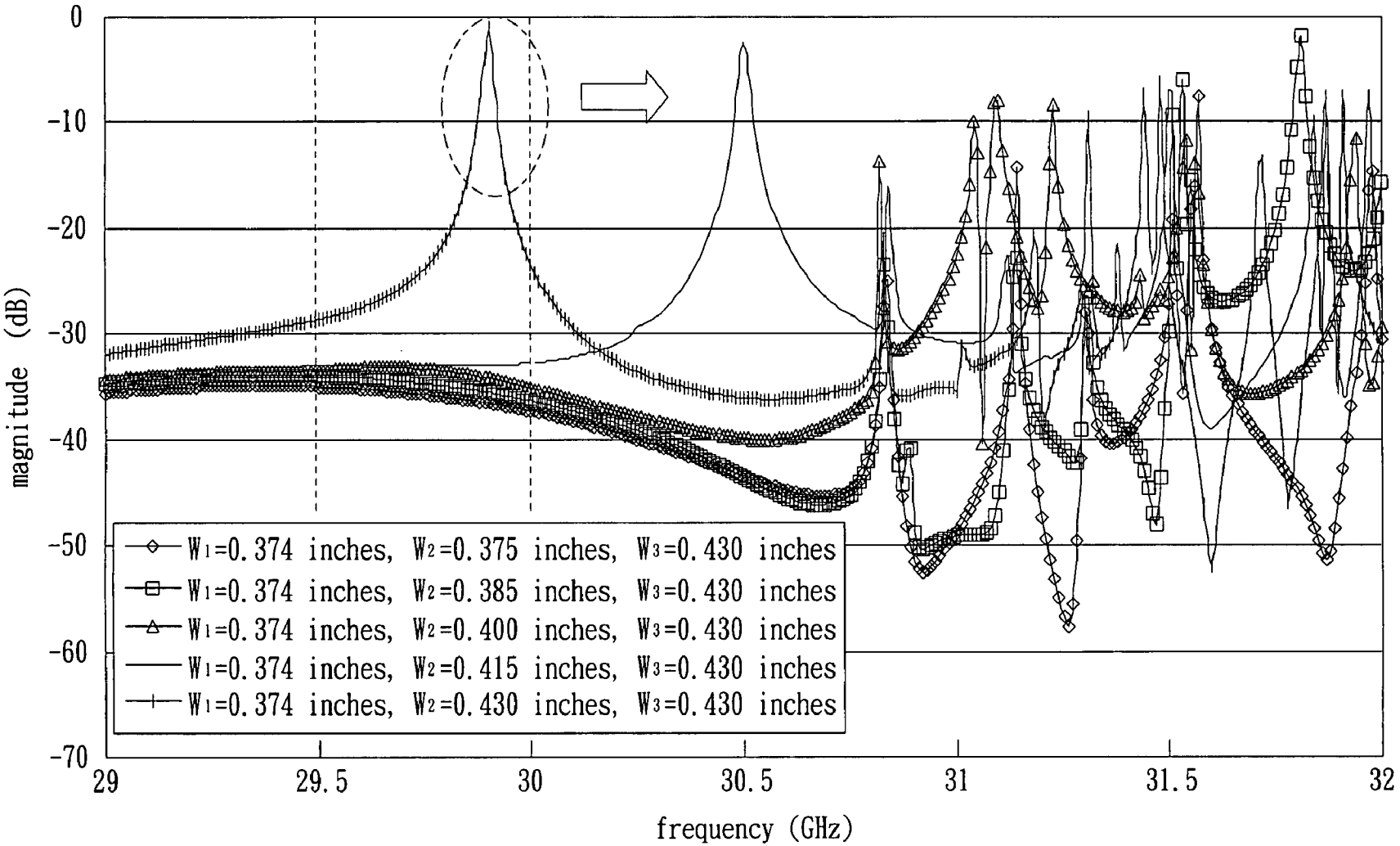
FIG. 2C shows yet another transmitting frequency response of the first embodiment of the present invention.

FIG. 2C shows yet another transmitting frequency (GHz) vs. magnitude (dB) response of the first embodiment of the present invention. As shown in FIG. 2C, when $W_1$ is fixed at 0.374 inches and $W_3$ is fixed at 0.43 inches, as $W_2$ becomes shorter (from 0.43 inches to 0.375 inches), the spikes induced become farther away from the transmitting band of the waveguide 10. As shown in FIG. 2C, when $W_2$ is 0.43 inches, a spike is induced as marked by the encircled portion. As $W_2$ becomes shorter (from 0.43 inches to 0.375 inches), the spikes induced become farther away from the transmitting band of 29.5 GHz to 30 GHz as marked by the arrow. Preferably, the ratio of $W_2$ to $W_1$ is smaller than 1.07.

On the other hand, to improve the quality of the receiving signals affected by the reflecting signals of the waveguide 10, $W_1$ is lengthened in the first embodiment of the present invention to reduce the proportion of the reflecting signals in the receiving band.

Figure 3:
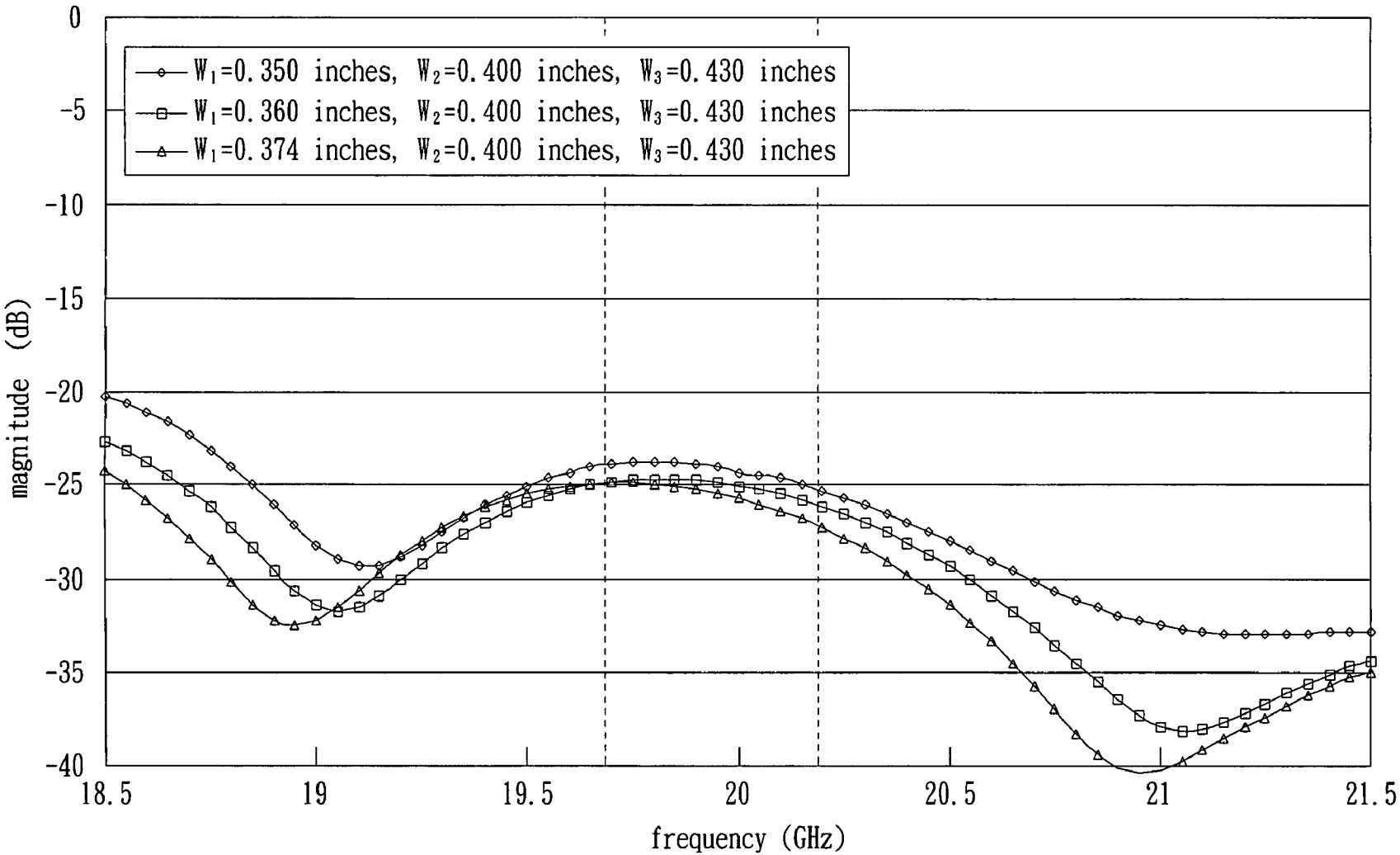
FIG. 3 shows a receiving frequency response of the first embodiment of the present invention.

FIG. 3 shows a receiving frequency (GHz) vs. magnitude (dB) response of the first embodiment of the present invention. As shown in FIG. 3, when $W_2$ is fixed at 0.4 inches and $W_3$ is fixed at 0.43 inches, as $W_1$ becomes longer (from 0.374 inches to 0.35 inches), the receiving frequency response becomes better. As shown in FIG. 3, as $W_1$ becomes longer (from 0.374 inches to 0.35 inches), the magnitude of the frequency response (dB) in the receiving band of 19.7 GHz to 20.2 GHz becomes higher. Preferably, $W_1$ is between 0.35 and 0.375 inches.

As can be seen from FIG. 1A to FIG. 3, when applied in K band (18 GHz to 26.5 GHz) and Ka band (26.5 GHz to 40 GHz), the waveguide 10 of the first embodiment of the present invention can effectively improve the conventional waveguides and enhance their transmitting and receiving qualities.

Figure 4:
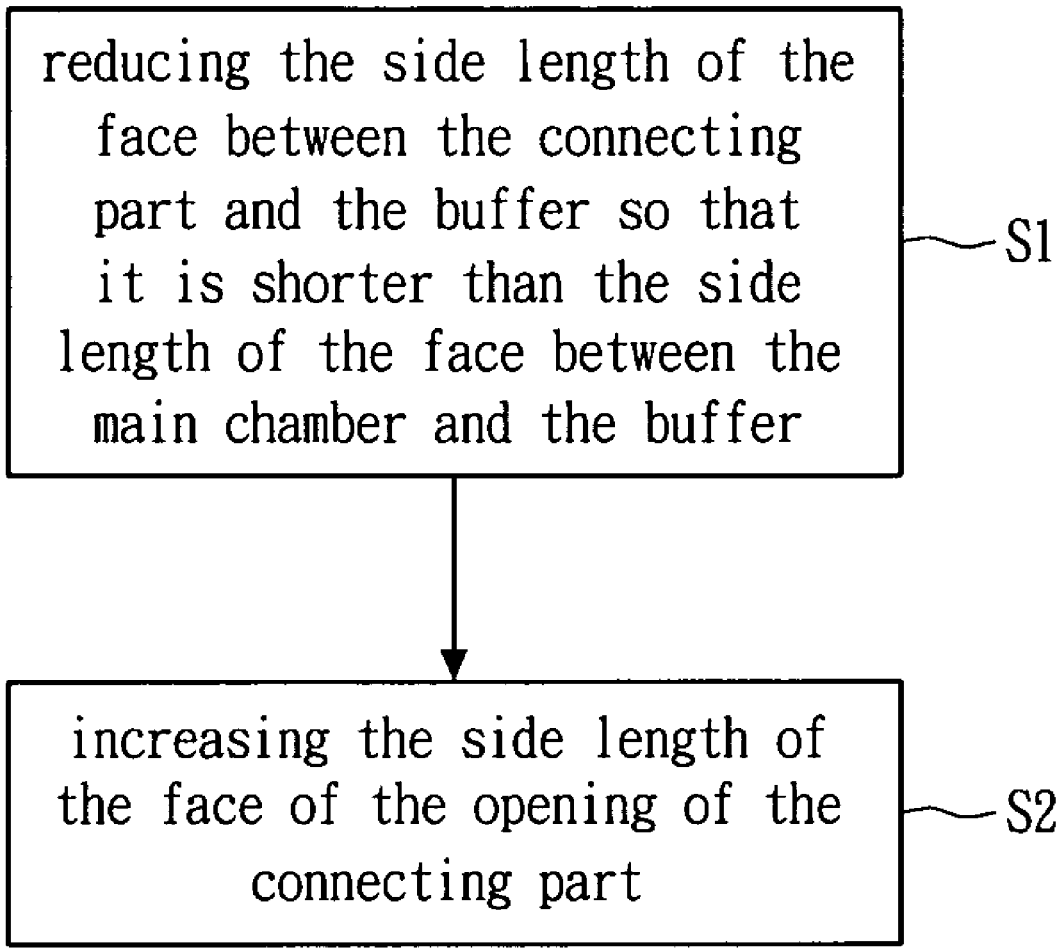
FIG. 4 shows a method for adjusting the structure of a waveguide to improve the quality of its transmitting and receiving signals of the second embodiment of the present invention.

FIG. 4 shows a method for adjusting the structure of a waveguide to improve the quality of its transmitting and receiving signals of the second embodiment of the present invention. The waveguide includes a connecting part connected to a main chamber via a buffer. The connecting part is a power splitter and is connected to a signal processing unit. The main chamber is a polarizer and is connected to a signal processing unit. In Step S1, the side length of the junction between the connecting part and the buffer is reduced so that it is shorter than that of the junction between the main chamber and the buffer. In Step S2, the side length of the opening end of the connecting part is increased.

The cross-junction of the waveguide of the present invention is not limited to a square shape as in the first embodiment, but can also include all kinds of shapes such as triangular shape, hexagonal shape, circular shape, and so on.

The above-described embodiments of the present invention are intended to be illustrative only. Those skilled in the art may devise numerous alternative embodiments without departing from the scope of the following claims.

What is claimed is:

1. A waveguide comprising:

a connecting part;

a main chamber; and a buffer connecting the connecting part and the main chamber;

wherein a side length of the junction between the connecting part and the buffer is smaller than a side length of the junction between the buffer and the main chamber; and wherein the main chamber is a dual-band corrugated polarizer.

2. The waveguide of claim 1, wherein the ratio of the side length of the junction between the connecting part and the buffer to a side length of an opening end of the connecting part is smaller than 1.2.

3. The waveguide of claim 1, wherein the ratio of the side length of the junction between the connecting part and the buffer to a length of an opening end of the connecting part is smaller than 1.07.

4. The waveguide of claim 1, wherein a side length of an opening end of the connecting part is between 0.35 to 0.375 inches.

5. The waveguide of claim 1, wherein the side length of the junction between the main chamber and the buffer is between 0.425 to 0.435 inches.

6. The waveguide of claim 1, wherein the connecting part is a power splitter.

7. The waveguide of claim 1, which is applied to Ka band.

8. The waveguide of claim 1, which is applied to K band.

9. A waveguide comprising:

a connecting part;

a main chamber; and a buffer connecting the connecting part and the main chamber;

wherein a side length of the junction between the connecting part and the buffer is smaller than a side length of the junction between the buffer and the main chamber; and wherein the junctions each are in a square form.

10. The waveguide of claim 9, which is applied to K band.

11. The waveguide of claim 9, wherein the ratio of the side length of the junction between the connecting part and the buffer to a side length of an opening end of the connecting part is smaller than 1.2.

12. The waveguide of claim 9, wherein the ratio of the side length of the junction between the connecting part and the buffer to a length of an opening end of the connecting part is smaller than 1.07.

13. The waveguide of claim 9, wherein a side length of an opening end of the connecting part is between 0.35 to 0.375 inches.

14. The waveguide of claim 9, wherein the side length of the junction between the main chamber and the buffer is between 0.425 to 0.435 inches.

15. The waveguide of claim 9, wherein the connecting part is a power splitter.

16. The waveguide of claim 9, wherein the main chamber is a polarizer.

17. The waveguide of claim 9, which is applied to Ka band.

* * * * *